US008899503B2

(12) United States Patent
Yu et al.

(10) Patent No.: US 8,899,503 B2
(45) Date of Patent: Dec. 2, 2014

(54) SCISSOR TYPE HAMMER MILL

(76) Inventors: Xinguo Yu, Shanghai (CN); Qicheng Le, Shanghai (CN); Zheng Yu, Shanghai (CN)

( * ) Notice: Subject to any disclaimer, the term of this patent is extended or adjusted under 35 U.S.C. 154(b) by 383 days.

(21) Appl. No.: 13/322,380

(22) PCT Filed: May 25, 2010

(86) PCT No.: PCT/CN2010/073197

§ 371 (c)(1),
(2), (4) Date: Nov. 23, 2011

(87) PCT Pub. No.: WO2010/135982

PCT Pub. Date: Dec. 2, 2010

(65) Prior Publication Data

US 2012/0067988 A1 Mar. 22, 2012

(30) Foreign Application Priority Data

May 26, 2009 (CN) ..... 2009 1 0051976

(51) Int. Cl.

| | |
|---|---|
| ***B02C 13/28*** | (2006.01) |
| ***B02C 13/284*** | (2006.01) |
| ***B02C 13/06*** | (2006.01) |
| ***B02C 13/04*** | (2006.01) |

(52) U.S. Cl.

CPC ..... *B02C 13/06* (2013.01); *B02C 13/284* (2013.01); *B02C 13/04* (2013.01)

USPC ..... 241/73; 241/189.1; 241/190

(58) Field of Classification Search

CPC ..... B02C 13/04; B02C 13/06; B02C 13/284; B02C 13/282; B02C 2013/282; B02C 13/28

USPC ..... 241/189.1, 190, 73

See application file for complete search history.

(56) References Cited

U.S. PATENT DOCUMENTS 3,011,220 A 12/1961 Keller et al.
3,412,770 A * 11/1968 Johnson ..... 241/243

(Continued)

FOREIGN PATENT DOCUMENTS

CN 2149966 Y 12/1993
CN 1153083 A 7/1997

(Continued)

OTHER PUBLICATIONS

International Search Report issued for International Patent Application No. PCT/CN2010/073197 mailed Aug. 19, 2010, 6 pages.

*Primary Examiner* — Mark Rosenbaum
(74) *Attorney, Agent, or Firm* — Morrison & Foerster LLP

(57) ABSTRACT

A scissor type hammer mill, mainly includes an inlet (1), hammers (2), a rotor (3), a screen (9) and a screen carriage (13) thereof, an outlet (7), a hammermill body (8), and a motor (6), and further includes a stationary hammer frame (4) and stationary hammer blades (5) provided on the stationary hammer frame (4). The stationary hammer frame is fixed on the hammermill body, and the stationary hammer blades are fixed on the stationary hammer frame, the stationary hammer blades are mounted in parallel to a rotation plane of the hammers with a distance therebetween. When the material enters into the cavity of the hammer mill, the material form a rotating material ring after being hit by the hammers, and the material is milled once again after the material ring hits the stationary hammer blade. Meanwhile, the stationary hammer blades lower the rotation speed of the material ring and change the moving direction of the material, and a component force for the movement of material towards a normal direction of the screen apertures is increased, which facilitates improving the milling efficiency, and improve the uniformity of the material to be milled.

11 Claims, 3 Drawing Sheets

(56) References Cited

U.S. PATENT DOCUMENTS

| | | | | |
|---|---|---|---|---|
| 3,929,293 | A * | 12/1975 | Hahn et al. | 241/42 |
| 4,753,395 | A * | 6/1988 | Paugh | 241/88.4 |
| 6,330,982 | B1 | 12/2001 | Yu et al. | |
| 2012/0067988 | A1 | 3/2012 | Yu et al. | |

FOREIGN PATENT DOCUMENTS

| | | | |
|---|---|---|---|
| CN | 2452611 | Y | 10/2001 |
| CN | 2619718 | Y | 6/2004 |
| CN | 2645764 | Y | 10/2004 |
| CN | 1651145 | A | 8/2005 |
| CN | 2751881 | Y | 1/2006 |
| CN | 1895786 | A | 1/2007 |
| CN | 2928237 | Y | 8/2007 |
| CN | 101214458 | A | 7/2008 |
| CN | 201500548 | U | 6/2009 |
| CN | 101596474 | A | 12/2009 |
| CN | 101607222 | A | 12/2009 |

* cited by examiner

SCISSOR TYPE HAMMER MILL

CROSS-REFERENCE TO RELATED APPLICATIONS

This application is the national phase of PCT application PCT/CN2010/073197 having an international filing date of 25 May 2010, which claims benefit of Chinese application No. 200910051976.0 filed 26 May 2009. The contents of the above patent applications are incorporated by reference herein in their entirety.

FIELD OF INVENTION

The present invention relates to a milling apparatus used in feedstuff industry, food industry, chemical industry, medical industry or the like, especially relates to a scissor type hammer mill.

DESCRIPTION OF THE RELATED ART

A scissor type Hammer mill generally consists of an inlet, a hammermill body, a rotor, hammers, a screen and a screen carriage thereof, a motor, an outlet, and so on. In operation, the rotor is driven by the motor, so that the hammers on the rotor rotate. The material is crushed or milled by the hitting of the hammer after entering through the inlet, then the milled material particles pass through the apertures of the screen and are expelled through the outlet. The hammer mills in the prior art have the following deficiencies.

1. The material enters through the inlet in a downward direction, and the hammers of the hammer mill hit the material in a tangential direction with a high hitting speed relative to the material. Such a high speed can facilitate improving the crushing or milling efficiency, however, just after entering, the material will move in the same direction with the hammers, so the speed of the hammers relative to the material will decrease substantially. However, only when the speed of the hammers with respect to the material is high, will the milling efficiency be improved.

2. In order to improve the milling efficiency of the hammer mill, the hammers shall have a very high moving speed, such as about 100 m/s, for plants and animals materials. In an area corresponding to the arc of the screen, the material will also move in the same direction with the action of the hammers at about 50-100 m/s. However, it is usually desired that the material features a relative lower moving speed at the screen surface, so that when the material passes through the screen surface in a tangent direction of a circle, it will have opportunity and enough time for passing through the screen apertures, which will result in an improved output and uniformity for the material to be milled. According to the diameter of the screen apertures and the thickness of the screen commonly used at present, the screening effects will be better if the speed of the material powder particles is at 1-20 m/s, which will substantially improve the output and uniformity of the powder particles. However, the hammer mill in the prior art cannot meet both of the requirements on high speed for hammers and low speed for material at the screen surface.

3. The material moves in a tangent direction of the screen surface, while the material screen apertures are in a normal direction of the screen surface, which is disadvantageous for discharging the material.

The above problems are key problems that puzzle in further improving the hammer mill technology for a long time.

SUMMARY OF THE INVENTION

The purpose of the present invention is to overcome the above technical problem by providing a scissor type hammer mill, which can effectively improve the milling efficiency and the uniformity of the powder particles.

The purpose of the present invention is realized by the following technical solution. A scissor type hammer mill, mainly includes an inlet, hammers, a rotor, a screen and a screen carriage thereof, an outlet, a hammermill body, and a motor, and further includes a stationary hammer frame and stationary hammer blades provided on the stationary hammer frame, the stationary hammer frame is fixed on the hammermill body, and the stationary hammer blades are fixed on the stationary hammer frame; the stationary hammer blades are mounted in parallel to a rotation plane of the hammers with a distance therebetween. As the hammers rotate, they will not contact the stationary hammer frame and the stationary hammer blades. When the material enters into the hammer mill, it will form a rotating material ring after being hit by the hammers, and the material is milled once again after the material ring hits the stationary hammer blades. Meanwhile, the stationary hammer blades reduce the rotating speed of the material ring, so that the material moves on the surface of the screen in a low speed, which facilitates passing the powder particles through the screen apertures.

The screen is mounted on a screen carriage, below which a vibration motor can be provided. The vibration motor is connected to the screen carriage. The screen carriage is separated from the hammermill body by a vibration isolating device such as a spring, so that the screen and screen carriage thereof can be vibrated independently. The screen does not contact the stationary hammer blades and the hammers. As the screen is vibrated, the screen apertures are continuously cleaned, which substantially improves the screening capacity for the milled material, thereby effectively reducing the phenomenon of screen blinding.

A distance of 1-50 mm from the stationary hammer blades to the rotation plane of the hammers is proper, and such a distance is determined according to the milling requirements. For relative finer powder particles, a smaller distance can be selected. The distance can be regulated by adjusting a width of a hammer spacing sleeve. By replacing the hammer spacing sleeve with another sleeve of different width, the distance from the stationary hammer blade to the hammer rotation plane can be changed, or such a distance can be regulated by adjusting the thickness of the stationary hammer blades.

The number of the stationary hammer blades on the stationary hammer frame can be one or more, and the stationary hammer blades may be sheet-shaped, with its plane shape being any one of triangle, trapeze, polygon, arc or a combination thereof. The stationary hammer blades may be welded on the stationary hammer frame, or the stationary hammer blades can be detachable, such as being threadedly fixed on the stationary hammer frame by bolts. When the stationary hammer blades and the hammer meet with each other, the met edges of them form an acute angle β, if viewed in a plane vertical to the rotation axis of the rotor. Thus, the stationary hammer blades and the hammers are in the form of scissors when they meet with each other, which facilitate improving the scissor type milling to the material. Thanks to the provision of stationary hammer blades, the movement of the material is hindered, so that the hitting speed of the hammers relative to the material is increased. Meanwhile, the moving speed of the material at the screen surface corresponding to the screen is lowered, which can facilitate expelling the material. Furthermore, with the guiding action resulted from the acute angle β between the hammers and the stationary hammer blades, a component force in the direction of the screen apertures is produced, which moves the material towards the screen apertures. The above mentioned acute angle β is generally preferred in 10-60 degrees, and can be adjusted according to the specific requirement. The angle can be adjusted in a certain scope by, for example, adjusting the bolts for securing the stationary hammer blades, in particular, pre-setting a space for adjusting the bolt. Surely, when the stationary hammer blades and the hammers meet with each other, their edges may also be parallel with each other. The hammers may rotate clockwise or anti-clockwise, so the hammers are generally bilateral symmetry, so that either side of the stationary hammer blades can meet with the hammers.

The number of the stationary hammer frames can be one or more, according to the width of the cavity of the hammer mill. The stationary hammer frame usually can be plate-shaped and arranged in parallel with the hammer rotation plane. The stationary hammer frame can be an annular plate with a through hole in the center, the hole has a diameter larger than that of the rotor, so that the stationary hammer frame does not contact the rotor. One or more stationary hammer blades are provided on the periphery of the stationary hammer frame, and, one or more projections are provided to extend outwardly from the annular periphery of the stationary hammer frame. The projections are connected to the hammermill body, so as to secure the stationary hammer frame on the hammermill body.

In order to improve the wear resistance and toughness, the stationary hammer blades and the stationary hammer frame can be made of an alloy steel with high strength, or can be made by welding a high strength alloy steel on the surfaces of a plain steel.

The present invention can be used in horizontal hammer mill, or can be used in vertical hammer mill or other types of hammer mills.

In the hammer mill mounted with the stationary hammer frame and stationary hammer blades arranged according to the aforementioned structure, the hammers of the hammer mill can maintain a relative large speed difference with respect to the material, not only at the hammer mill inlets, but also at the area corresponding to the arc of the screen. Meanwhile, both the high speed of the hammer and the low speed of the material at the screen surface can be realized. When the hammers rotate to meet with the stationary hammer blades, an angle in the form of scissors is formed, so that the moving direction of the material can be changed by the guidance of a side of the stationary hammer blades, which increases a component force for the movement of material towards a normal direction to the screen apertures, thereby facilitating improving the milling efficiency, and further improving the uniformity of the material to be milled.

DESCRIPTIONS OF THE DRAWINGS

EMBODIMENTS

The present invention will be further described in detail by referring to the embodiments and the drawings.

Figure 2:
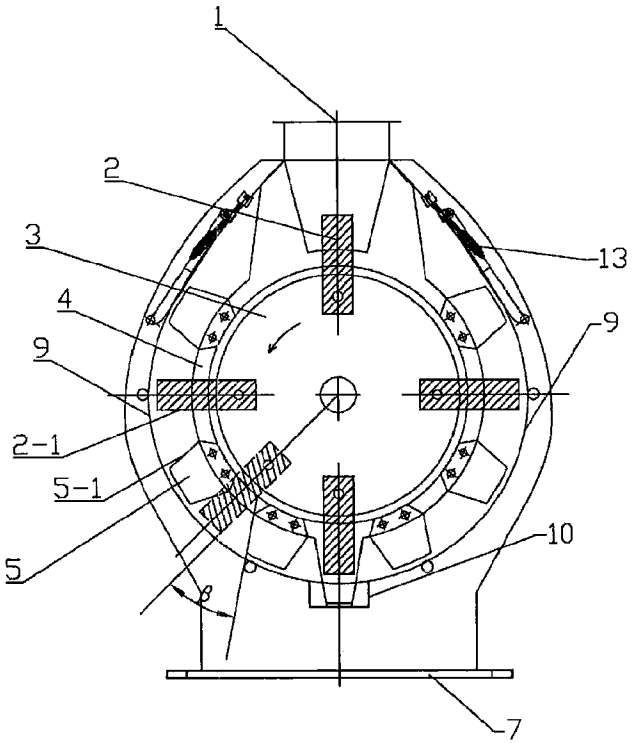
FIG. 2 is a sectional view taken along the line A-A in FIG. 1.
Figure 1:
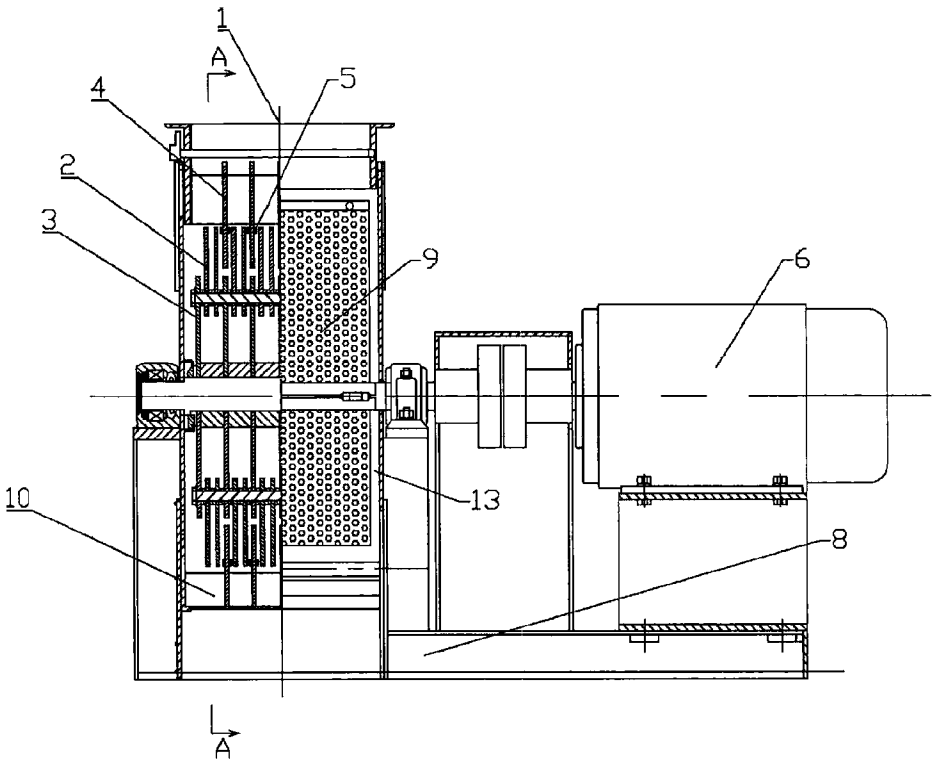
FIG. 1 is a diagrammatic view showing a structure of a first embodiment of the present invention.

The hammer mill as shown in FIGS. 1 and 2 is a horizontal hammer mill, consisting of an inlet 1, hammers 2, a rotor 3, a stationary hammer frame 4, a motor 6, an outlet 7, a hammermill body 8, a screen 9, and a screen carriage 13, or the like.

The stationary hammer frame 4 is in annular shape with a hole in the center thereof. The hole has a diameter larger than that of the rotor so that the stationary hammer frame does not contact the rotor 3. An upper portion and a lower portion of an annular periphery of the stationary hammer frame extend outwardly so as to form projections 4-1 and 4-2, which are connected and secured to the hammermill body 8, respectively, at proper positions on hammer mill inlet 1 and impact groove 10. There are five stationary hammer frames, which are mounted between the hammers 2 and are mounted in parallel to the rotation plane of the hammers 2. Each stationary hammer frame 4 is provided with six stationary hammer blades 5 on an annular periphery thereof.

The stationary hammer blades 5 are threadedly connected to the stationary hammer frame 4 by bolts, and the stationary hammer blades 5 face the rotation plane of the hammers 2 with a distance of 5 mm The portions of the stationary hammer blades 5 that project out of the annular periphery of the stationary hammer frame are in an isosceles trapezoid shape. When edges 5-1 of the stationary hammer blades 5 meet with side edges 2-1 of the hammers 2, an angle β, when viewed in a plane vertical to the rotation axis of the rotor 3, is preferably 30 degrees. The angle β can be regulated by adjusting a position that the bolt for securing the stationary hammer blades takes in an ellipse hole in the stationary hammer frame. The portions of the stationary hammer blades 5 and the hammers 2 that are in contact with the materials are made of alloy steel with high strength.

The hammers 2 are mounted in four groups, each group of hammers are secured with each other by spacing sleeves. When the hammers 2 rotate, they will not contact the stationary hammer frame 4 and the stationary hammer blades 5. The stationary hammer blades 5 face the rotation plane of the hammers 2, and the stationary hammer blades 5 meet with the hammers 2 so as to form a scissors shape. When the material enters through the inlet 1, it is hit by the hammers 2 and hits onto the stationary hammer blades 5. Since the material is blocked, it can help in increasing relative hitting speed with the hammers, thereby effectively improving the milling efficiency for the material. When blocked by the stationary hammer blades 5, the moving speed of the material on the surface of the screen 9, corresponding to the stationary hammer blades, is reduced, thereby helping in passing the material through the screen apertures, and hence improving the output and the uniformity. Further, the side edges 5-1 of the stationary hammer blades that meet with the hammers 2 form an angle β of 30 degrees with the edges 2-1 of the hammers, and the sides of the stationary hammer blades are in a flared or inclined shape towards the screen. Thus, the material is hit and scissor-cut by the hammers and the stationary hammer blades, so that it facilitates generating a movement toward the screening apertures, and hence facilitate passing the material through the screening apertures.

Figure 4:
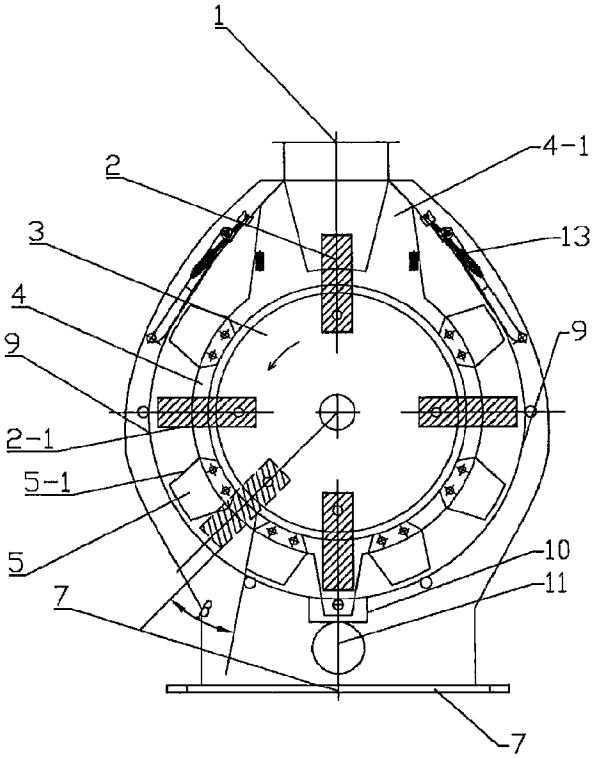
FIG. 4 is a sectional view taken along the line B-B in FIG. 3.
Figure 3:
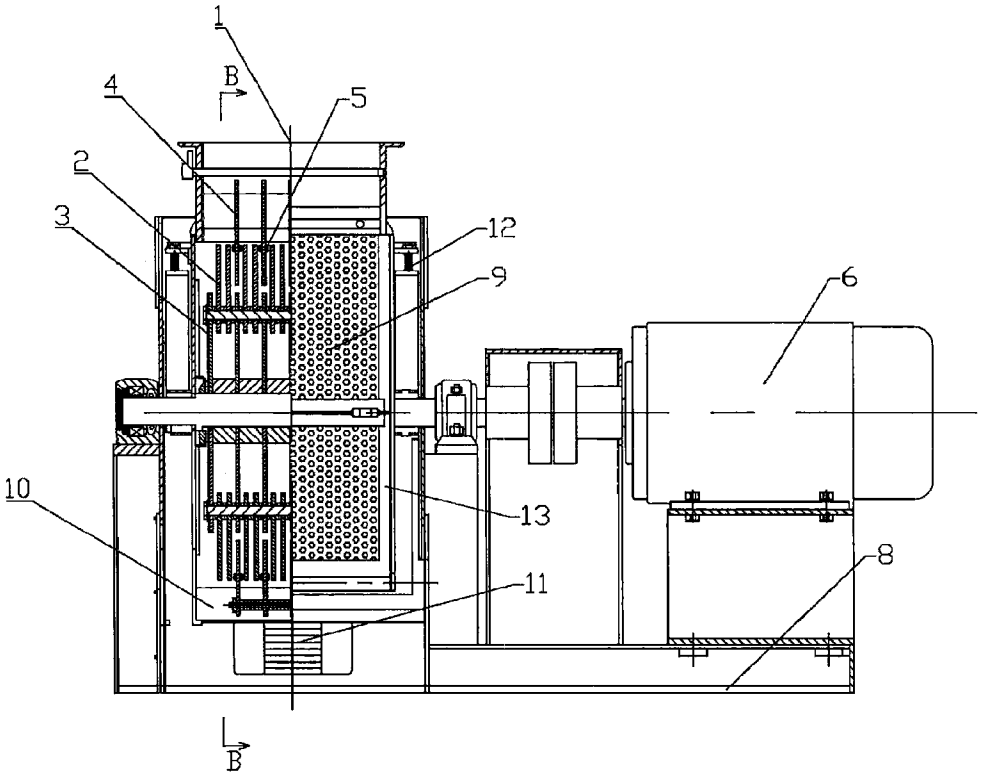
FIG. 3 is a diagrammatic view showing a structure of a second embodiment of the present invention.
Figure 5:
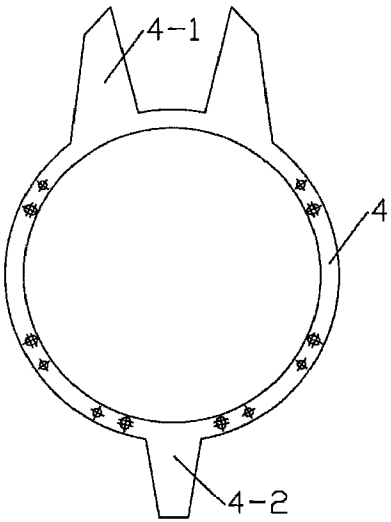
FIG. 5 is a diagrammatic view showing a structure of a stationary hammer frame in the embodiments of the present invention.

FIGS. 3 and 4 show another embodiment of the present invention. The hammer mill is a horizontal hammer mill, the basic structure of which is identical to the embodiment as shown in FIGS. 1 and 2. A screen is mounted on a screen carriage, while a vibration motor 11 is provided below the screen carriage 13. The vibration motor is connected with the screen carriage. The screen carriage and the screen are separated from the hammermill body 8 by a vibration isolating device, such as a spring 12 or the like, so that the screen 9 and the screen carriage 13 can vibrate independently, with the screen 9 does not contact the stationary hammer blades 5 and the hammers 2. The vibration amplitude of the screen is in a range of 1-5 mm, with vibration frequency of 50 Hz. By means of the vibration motor 11, the screen can be vibrated to reduce the phenomenon of screen blinding, especially in the cases of small screen aperture, fine powder, material with high moisture, high content of fibers. In addition, projections 4-1 are provided on upper portion of the stationary hammer frame, and the lower portion of the stationary hammer frame is provided with bolt holes and is connected to the hammermill body 8 by bolts.

The preferred embodiments of the present invention is described as in the above, and do not intend to limit the scope of the present invention. Any modifications, equalities or variations to the above embodiments within the principle of the present invention are all included in the scope of the present invention.

The invention claimed is:

1. A scissor type hammer mill, mainly including an inlet, hammers, a rotor, a screen and a screen carriage thereof, an outlet, a hammermill body, and a motor, wherein the hammer mill further includes a stationary hammer frame and stationary hammer blades provided on the stationary hammer frame, the stationary hammer frame is connected to the hammermill body, the stationary hammer blades face a rotation plane of the hammers with a distance therebetween, wherein when the stationary hammer blades and the hammers meet with each other, met edges of the hammer blades and the hammers, when viewed in a plane vertical to a rotation axis of the rotor, form acute angles so that a component force in a direction to the screen is produced.

2. The scissor type hammer mill of claim 1, wherein a vibration motor is provided below the screen carriage, the vibration motor is connected to the screen carriage, the screen carriage and the screen are separated from the hammermill body by a vibration isolating device so that the screen and the screen carriage can vibrate independently.

3. The scissor type hammer mill of claim 2, wherein the distance between the stationary hammer blades and the rotation plane of the hammers is 1-50 mm.

4. The scissor type hammer mill of claim 2, wherein the distance between the stationary hammer blades and the rotation plane of the hammers is adjustable by replacing a hammer spacing sleeve with another hammer spacing sleeve of different width or by adjusting the thickness of the stationary hammer blades.

5. The scissor type hammer mill of claim 2, wherein the stationary hammer frame is plate-shaped and arranged in parallel with the rotation plane of the hammers.

6. The scissor type hammer mill of claim 1, wherein the distance between the stationary hammer blades and the rotation plane of the hammers is 1-50 mm.

7. The scissor type hammer mill of claim 1, wherein the distance between the stationary hammer blades and the rotation plane of the hammers is adjustable by replacing a hammer spacing sleeve with another hammer spacing sleeve of different width or by adjusting the thickness of the stationary hammer blades.

8. The scissor type hammer mill of claim 7, wherein the stationary hammer blades is sheet-shaped, with its plane shape being any one of triangle, trapeze, polygon or arc, or can be a combination thereof.

9. The scissor type hammer mill of claim 1 wherein the acute angle is 10-60 degrees.

10. The scissor type hammer mill of claim 1, wherein the stationary hammer frame is plate-shaped and arranged in parallel with the rotation plane of the hammers.

11. The scissor type hammer mill of claim 10, wherein the stationary hammer frame is annular-shaped with a through hole in the center, the hole has a diameter larger than that of the rotor, one or more projections are provided to extend outwardly from the annular periphery, the projections are connected to the hammermill body.

* * * * *